US007378609B1

(12) United States Patent
Fedorjaka

(10) Patent No.: US 7,378,609 B1
(45) Date of Patent: May 27, 2008

(54) METAL DOME SWITCH ASSEMBLY WITH ENHANCED SNAP RATIO

(76) Inventor: John Fedorjaka, 408 Maple Creek Ct., Apex, NC (US) 27502

( * ) Notice: Subject to any disclaimer, the term of this patent is extended or adjusted under 35 U.S.C. 154(b) by 0 days.

(21) Appl. No.: 11/745,685

(22) Filed: May 8, 2007

Related U.S. Application Data

(60) Provisional application No. 60/767,520, filed on May 10, 2006.

(51) Int. Cl.
*H01H 1/10* (2006.01)

(52) U.S. Cl. ..... 200/516; 200/512; 200/406

(58) Field of Classification Search ..... 200/512–517, 200/406, 341–345; 29/622
See application file for complete search history.

(56) References Cited

U.S. PATENT DOCUMENTS 5,986,228 A * 11/1999 Okamoto et al. ..... 200/516
6,595,653 B2 7/2003 Saito et al.
6,730,869 B2 * 5/2004 Teruyama et al. ..... 200/516
6,917,007 B2 7/2005 Hirai et al.
7,075,025 B2 * 7/2006 Tomitsuka et al. ..... 200/512

* cited by examiner

*Primary Examiner*—K. Richard Lee
(74) *Attorney, Agent, or Firm*—Ishman Law Firm P.C.

(57) ABSTRACT

A metal dome switch assembly with a good snap ratio and having a desired click characteristic near to that of an isolated metal dome includes a carrier base layer and adhesive layer which have a plurality of holes bounded by annular sections which engage the lower outer surfaces of the domes and are larger than the keypad actuation posts, at positions corresponding to fixed contact points on a circuit board. The switch array is especially important in cell phone designs where the snap ratio, tactile feel, is desirable. The switch array can also incorporate an electroluminescent (EL) lamp while still improving the snap ratio.

8 Claims, 7 Drawing Sheets

METAL DOME SWITCH ASSEMBLY WITH ENHANCED SNAP RATIO

RELATED APPLICATION

This application claims the benefit of U.S. Provisional Application No. 60/767,520 filed on May 10, 2006.

FIELD OF THE INVENTION

The present invention relates to dome-type switches and, in particular, a membrane switch assembly for low profile operating switch panels with a snap ratio and a click characteristic approaching an isolated metal dome.

BACKGROUND OF THE INVENTION

Low profile operating switch panels are used in smaller instruments, such as mobile telephones. Dome switches have been used for such applications and exhibit snap ratios and click characteristics providing desired tactile feedback to the user. Such attributes have been mitigated, however, by the need to isolate the panel circuitry from outside contaminants including humidity and particulates. A typical approach is disclosed in U.S. Pat. No. 6,917,007 wherein the metal dome switches are hermetically encased in composite carrier and adhesive layers. As a result of the composite structure, the flex characteristics of the dome, and accordingly the snap ratio are altered and tactile feedback mitigated, slightly but adversely from a user perspective.

The snap ratio, also referred to as tactile feel, is the response to an operator depressing a keypad and feeling a quick force drop (or click) at their fingertip. Generally, the snap ratio for a dome type switch is represented as shown below:

$$\text{Snap ratio (\%)} = \frac{(OF - RF)}{OF} \times 100$$

wherein, OF: (Operational Force) is the maximum value of load necessary for deforming the dome shape switch from open position dome shape to flexed state engaging fixed contacts in the closed position: and RF: (Recovery Force) is the value of resistive load at contact closed position. The desired snap ratio is reached when the result of the calculation is 50%. FIG. 7 is a graph illustrating the snap ratio for a single isolated dome (solid lines), for a typical encased prior art dome (dashed lines), and for a metal dome type switch according to the invention (dotted lines) and as described below. The ordinate designates load, and the abscissa designates operational distance. A large force OF is needed during travel after starting to depress the apex portion. However, when the apex portion is recessed to some degree, the necessary load is reduced and a small RF is sufficient to close the fixed contacts Keypads with snap ratios of 50% have excellent tactile feel and relatively long life. Keypads with snap ratios below 40% have relatively weak tactile feel, yet longer life. It can be determined from the above formula that snap ratio depends upon the variance between Operational Force (OF) and the Recovery Force (RF). This value will directly influence tactile feel, which is caused by force variation. That is, when the force drops from OF to RF, the operator can feel a force change at their fingertip immediately. There have been prior attempts to modify metal dome type switches to improve snap ratio as disclosed by example, U.S. Pat. No. 6,595,653 to Atsushi Saito wherein cut portions are provided along an outer peripheral edge of the dome shaped movable contacts. One shortcoming of this invention is that it includes cuts through the EL (electro luminescent) film to achieve an improved snap ratio. Also, under stress, the switch actuation can shear the adhesive interface between the dome contact and the cuts thereby compromising the hermetic sealing.

SUMMARY OF THE INVENTION

The present invention provides a metal dome array switch for use in low-profile operating switch panels providing a hermetically sealed unit with a good snap ratio and having a desired click characteristic near to that of an isolated metal dome. The dome array includes a carrier base layer and adhesive layer which have a plurality of holes bounded by annular sections which limitedly engage the lower peripheral surfaces of the metal domes. The holes are larger than the keypad actuation post allowing direct engagement with the domes. The switch array is especially important in cell phone designs where improved snap ratio and tactile feel are desirable. The switch array can also incorporate an electroluminescent (EL) lamp while still improving the snap ratio. The base layer of the array is adhered to the switch substrate to seal the circuitry and the domes. The limited peripheral sealing results in the needed operational requirements while having a minimal effect on the Operating Force and Recovery Force thus providing a snap ratio approaching the ideal isolated dome.

BRIEF DESCRIPTION OF THE DRAWINGS

The above and other features of the invention will become apparent upon reading the following description taken in conjunction with the accompanying drawings in which.

DETAILED DESCRIPTION OF THE PREFERRED EMBODIMENTS

Figure 1:
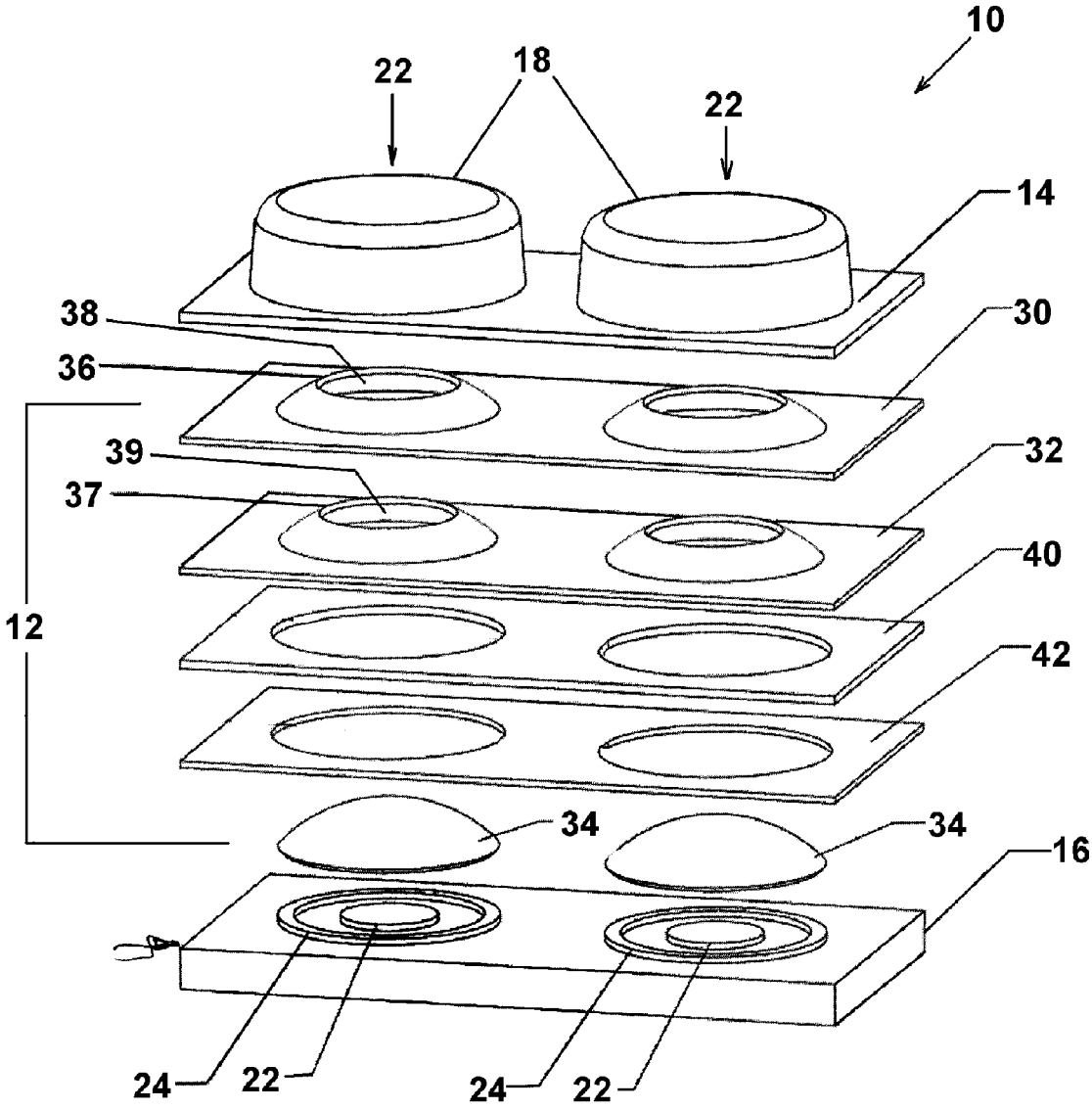
FIG. 1 is an exploded view of the membrane dome switch assembly in an operating panel according to a preferred embodiment of the invention.
Figure 2:
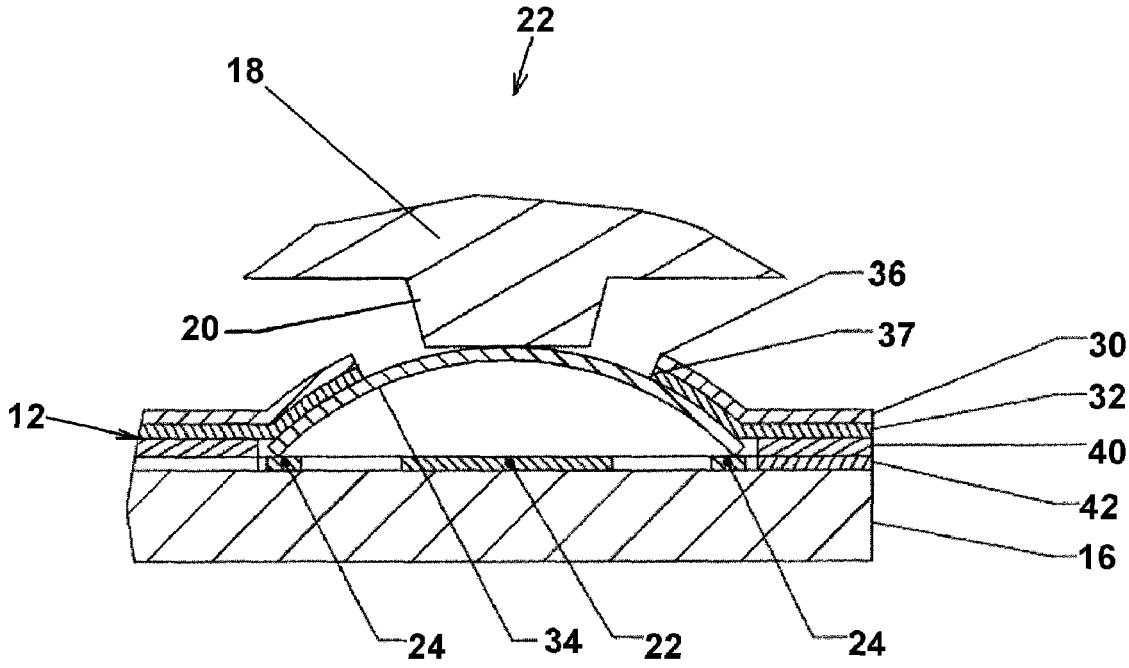
FIG. 2 is an enlarged cross sectional view of the switch assembly of FIG. 1 in the open position.
Figure 3:
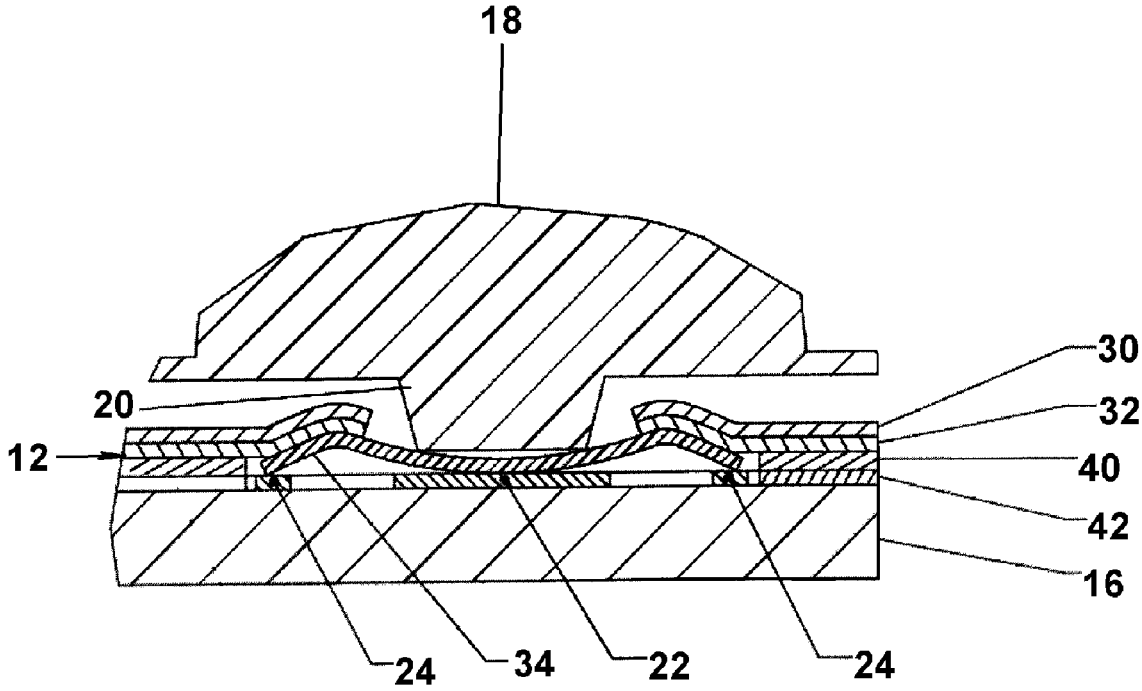
FIG. 3 is an enlarged cross sectional view of the switch assembly of FIG. 2 is the closed position.

Referring to FIGS. 1 through 3, there is shown an operating panel 10 for an electric or electronic instrument, such as a cell phone, having a low profile dome array membrane switch assembly 12 operatively interposed between a key pad 14 and a circuit board 16. The key pad 14 includes individual keys 18 having downwardly projecting frustoconical actuation posts 20 for selectively actuating dome switch units 22 in the switch assembly 12 to complete a circuit from the open position of FIG. 2 to the closed position of FIG. 3 whereat a select circuit is established between a center contact 23 and an annular outer contact 24 on the circuit board 16. Alternatively, both contacts may be centrally located and closed by the depressed section of the dome.

Figure 6:
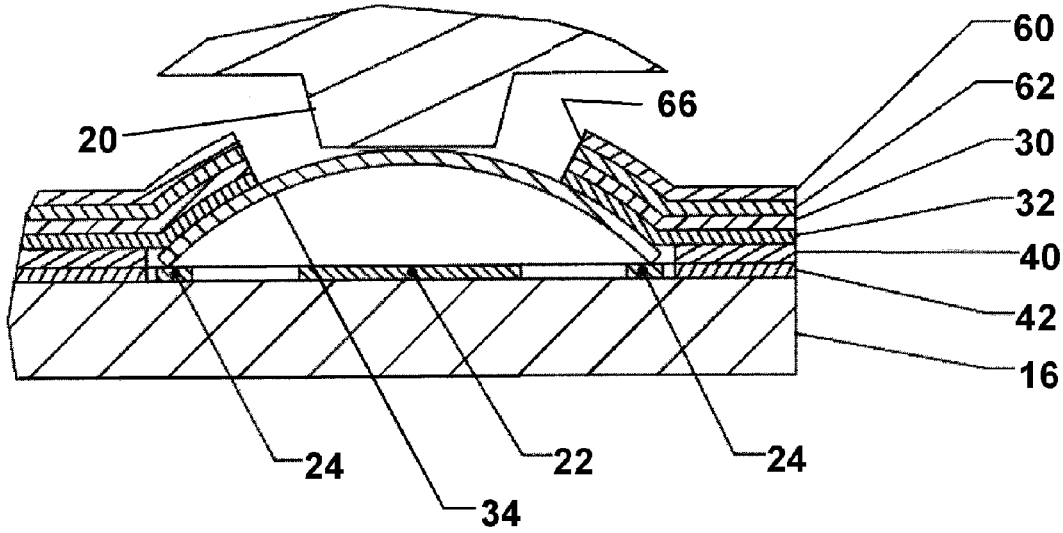
FIG. 6 is an enlarged cross sectional view of a switch assembly in accordance with another embodiment of the invention.
Figure 7:
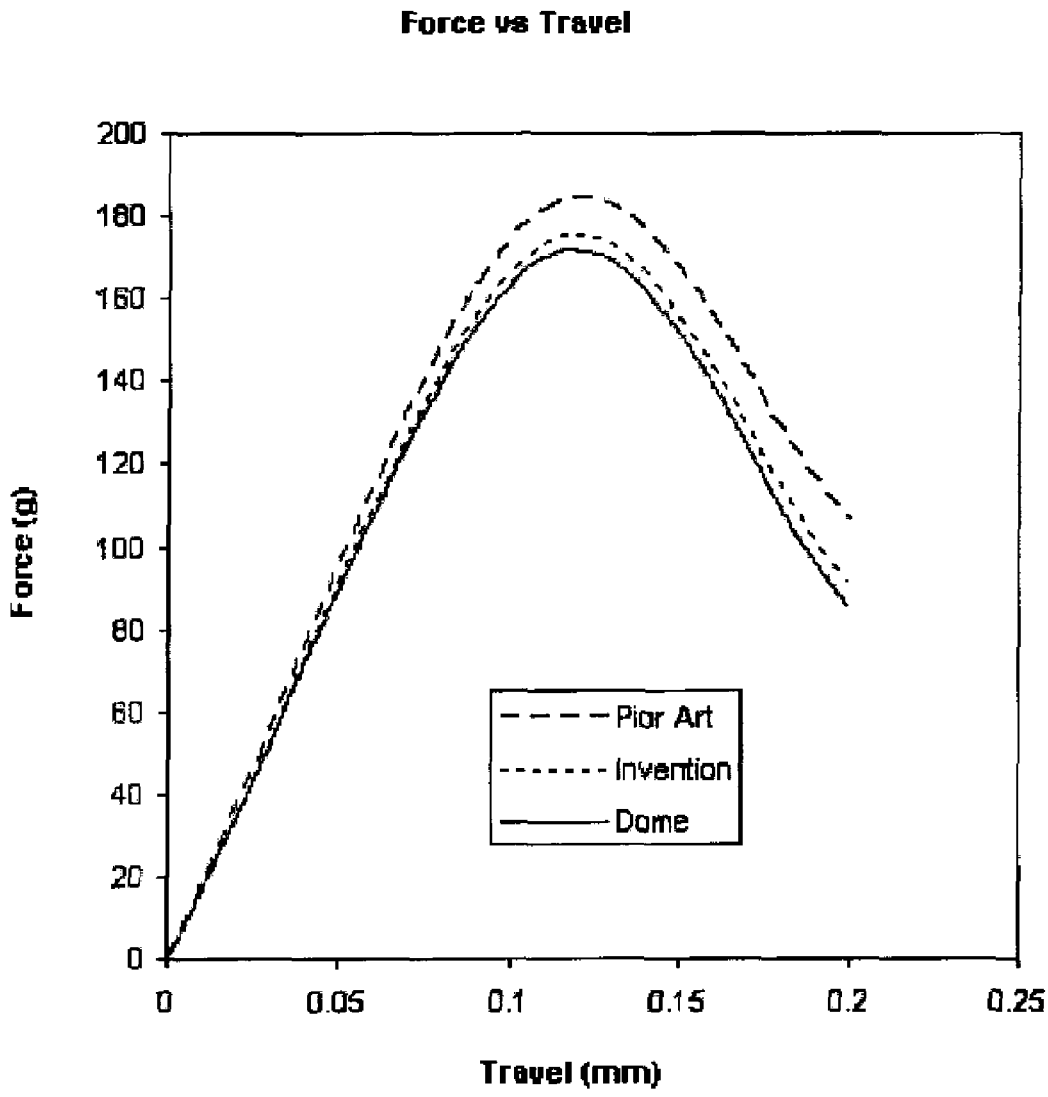
FIG. 7 is a graph illustrating the snap ratios of the present and prior switch assemblies and an isolated dome.

A typical prior art membrane dome array switch assembly 100 is shown in FIG. 6. The switch assembly includes a base layer 102 made from a thin flexible material such as polyethylene terephthalate (PET) or similar type material, an adhesive layer 104 adhered to the base layer 102; a plurality of domes 106 adhered at the upper surfaces to layer 104 and located at positions corresponding to fixed contact terminals 108 of a printed circuit board 110; a spacer layer 112 having a plurality of holes larger than the outer diameters of the dome 106, which is laminated to the lower surface of adhesive layer 104 and attached to positions corresponding to the metal domes 106; an adhesive layer 114 which is laminated to the spacer layer 112 and has a plurality of holes which are larger than the outer diameter of the dome 106. The adhesive layer is attached to corresponding positions on the printed circuit board 110. The board 110 includes a fixed center contact 118; and an annular fixed outer contact 120 which bring about an electrical connection when the metal domes 106 are depressed via a keypad 122 with center actuation post 124. It will thus be appreciated that the layers are in composite orientation with the domes and alter the operating and recovery forces as indicated in FIG. 7.

Referring to FIGS. 1 through 3, the present invention removes the composite resistance at the top of the domes and allows actuation with a snap ratio approaching isolated domes. The membrane switch assembly 12 includes a carrier base layer 30 having an adhesive layer 32 on a bottom surface attached to the lower and outer peripheral surfaces of a plurality of elastically deformable domes 34 located in assembly at positions corresponding to the fixed contacts 23, 24 on circuit board 16. Both layers 30, 32 have conformal hemispherical sectors or sleeves 36, 37 having center holes 38, 39, respectively. The holes have a smaller diameter than the outer diameter of the metal dome 34, and a larger diameter that than the keypad actuation post 22. Accordingly, the sectors 36, 37 adhesively engage only the outer peripheral bases of the domes thereby providing hermetic sealing and presenting only minimal composite rigidity that does not significantly alter the flexing of the domes and resultant actuation forces. A spacer layer 40 is attached to the adhesive layer 32 at a top surface and to a lower adhesive layer 42 at a lower surface. The layers 40, 42 include through holes having a diameter larger than the base of the domes 34 and coaxial therewith. The layer 42 is adhered to the top surface of the circuit board 16 placing the domes and posts in operative registry with the associated contacts 23, 24. The domes as illustrated are hemispherical about a vertical axis transverse to the circuit board; however, it will be appreciated that other conventional surfaces of revolution, parabolic or curvilinear, may be used as the dome shaped member. Suitable domes are stainless steel domes available in the P-series from Snaptron Inc., Windsor Colo. having diameters of 0.156 to 0.236 in. Dimples may be provided at the apexes, but are not required.

The actuation post 20 thus directly contacts the dome 34 with limited resistance at the sealed interface, which configuration results in an improved snap ratio near to that of a single isolated metal dome.

The base layer 30 is made from a thin flexible material such as polyethylene terephthalate (PET) or similar type material. The sections 36, 37 provide secure attachment of the domes 34 about their perimeter to the base layer 30 and adhesive layer 32. Although the perimeter of the domes 34 are secure and sealed, the center is free of carrier and adhesive materials. Having the actuation post 20 directly contact the domes 34 also results in a thinner metal dome array.

The hole sizes 38, 39 are determined by the size of the metal dome 34 and associated actuation post 22. The actuation post 20 is typically less than half the functional diameter of the metal dome 34, so as to maximize the actuation force towards the center of the dome. A 5 mm diameter metal dome might typically have an actuation post 20 diameters of approximately 2 mm. The minimum diameter of the hole should be greater than the diameter of the actuation post 22 so as to exclude the carrier base layer material from coming between the dome 34 and actuation post 22. A hole size of 3 mm would allow sufficient area for the actuation post diameter as well as a margin of error for tolerances associated in the manufacturing process of the metal dome array.

The maximum diameter of the hole should be such that it allows the dome 34 to be properly adhered to and secured to the base layer 30. A 3 mm hole for a 5 mm diameter metal dome would allow for 1 mm of overlapping contact area about the perimeter of the dome, with which to secure the dome. It has been determined that substantially improved snap ratios may be obtained wherein the hole diameter is between 40% to 60% of the dome base diameter. A lesser ratio can increase the recovery force lowering the snap ratio. A higher ratio can provide insufficient contact to maintain mechanical positioning and hermetic sealing during actuation.

Metal domes as described typically have a circular profile normal to the axis of operation, however, other dome shapes such as 3 leg (tri-lobe), four leg, or other designs, which use outer segments to engage the fixed outer contact 24.

Referring again to FIG. 7, single dome switch assemblies in accordance with the foregoing were tested with the results set forth below in Table 1.

TABLE 1

| Travel | Force (g) | | |
|---|---|---|---|
| (mm) | Dome | Prior Art | Invention |
| 0 | 0 | 0 | 0 |
| 0.11 | 170 | 181.2 | 173.6 |
| 0.2 | 85 | 106.4 | 90.7 |

It will be noted that the present invention provides a snap ratio of 47%. An isolated dome provides a switch's snap ratio is 49%. The prior art structure's snap ratio is 41%. Thus, the present invention has a good click characteristic proximate that of the single member of the metal dome.

Figure 4:
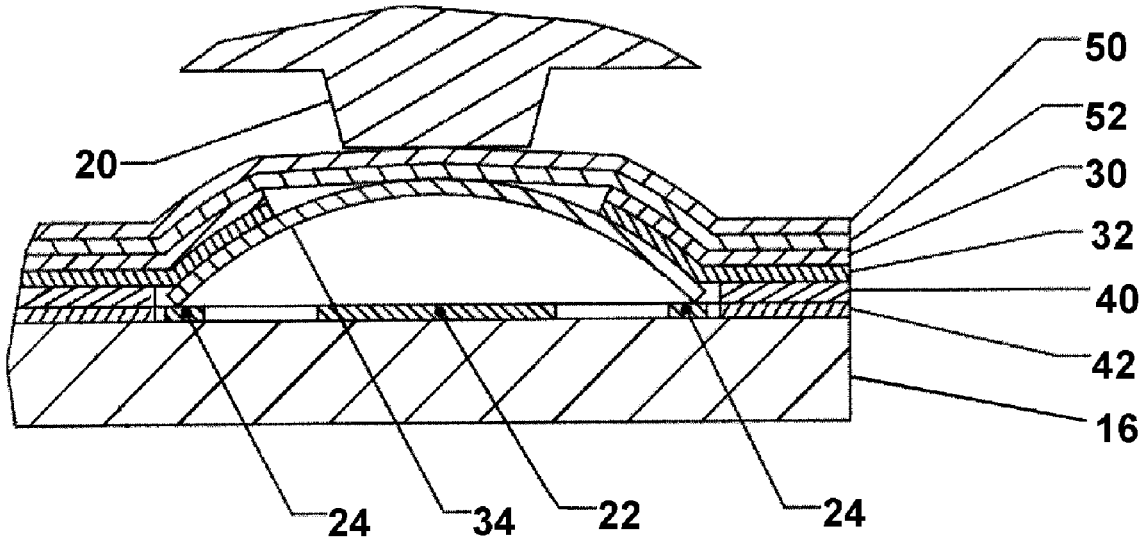
FIG. 4 is an enlarged cross sectional view of a switch assembly in accordance with another embodiment of the invention.
Figure 8:
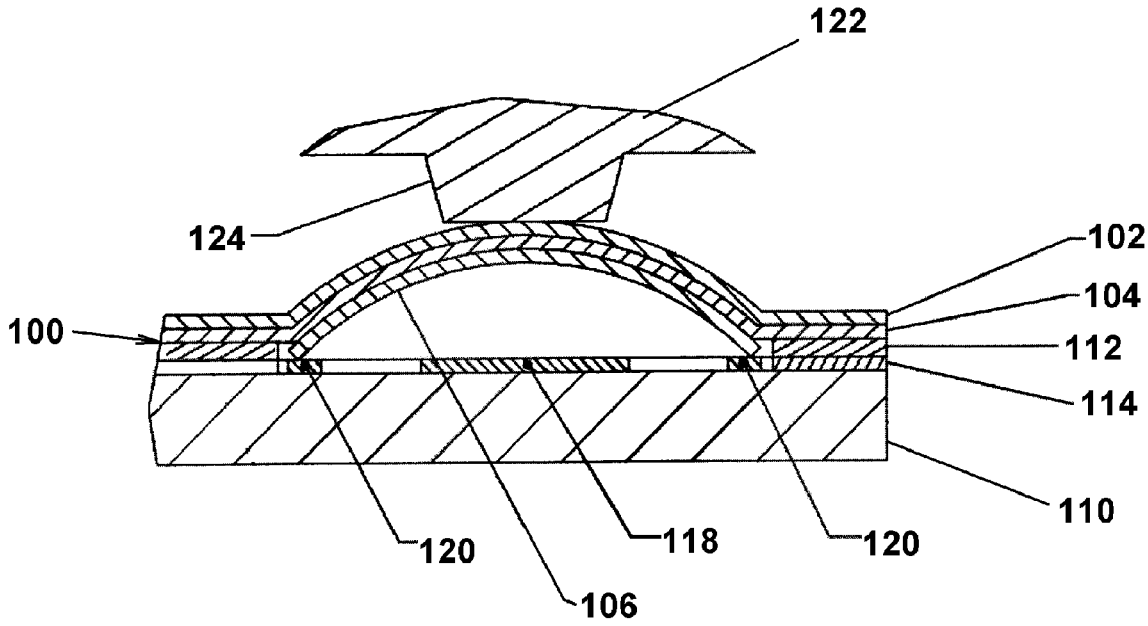
PRIOR ART FIG. 8
FIG. 8 is an enlarged cross sectional view of a prior art switch assembly.

Referring to FIG. 4, there is shown an embodiment of the invention which includes a thin flexible EL lamp 50 having an additional adhesive layer 52 adhered therebetween and the top carrier layer. The addition of the flexible EL lamp 50 and adhesive layer 52 slightly reduces the snap ratio, although still improved (higher) than in the prior art array of FIG. 8. It should also be noted that a liquid adhesive or other adhering agent could be used in the place of a double-sided adhesive film for the various adhesive layers, particularly adhesive layer 52 that adjoins the EL lamp 50. A liquid adhesive has the additional advantage of providing a thinner assembly between the keypad actuator and domes, which would improve the snap ratio.

Figure 5:
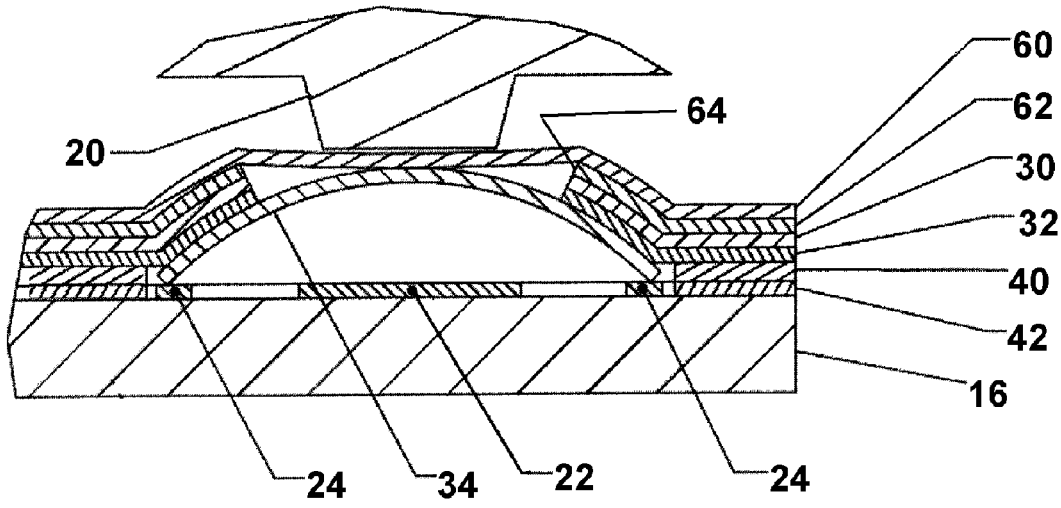
FIG. 5 is an enlarged cross sectional view of a switch assembly in accordance with another embodiment of the invention.

Referring to FIG. 5, there is shown a further embodiment which includes an EL lamp 60 having an additional adhesive layer 62 adhered therebetween and the top carrier layer. The adhesive layer 62 has a through hole 64 coaxial and the same diameter as the holes in the carrier layer. The holes in adhesive layer 62 may be a size similar to the holes in the carrier layer, although they can also be of a diameter larger than the metal dome. For a 5 mm dome, a hole of 5.5 mm may be used.

Referring to FIG. 6, there is shown a further embodiment in which a center hole 64 is provided in the lamp 60. The advantage of this embodiment is that it allows direct contact between the keypad actuator and the domes, although the holes in the EL lamp may less desirable since it could impact light output of the EL lamp.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed:

1. A switch assembly comprising:

an elastically deformable conductive dome;

a circuit board member supporting said dome at a lower peripheral rim and having contact members engaged by said dome upon elastic deformation thereof;

an actuator member engagable with an apex portion of said dome for elastically deforming said dome into engagement with said contact members; and a base layer made from a thin flexible material adhesively attached to said board member and including an aperture bounded by an annular section adhesively attached only to the outer and lower peripheral surfaces of said dome remote from said apex portion thereby forming a hermetic seal for said contact members and wherein said aperture is larger than said actuator member whereby said actuator member directly engages said dome, said annular section limitedly attached to said dome so as to not significantly alter the deformation characteristics thereof thereby providing a snap ratiod approaching an isolated dome.

2. The switch assembly as recited in claim 1 wherein said outer peripheral surface of said dome is a surface of revolution about an axis transverse to said board member.

3. The switch assembly as recited in claim 2 wherein said annular section is truncated parallel to said board member.

4. The switch assembly as recited in claim 3 wherein a continuous electroluminescent lamp layer is adhesively attached at a top surface of said base layer, overlies said aperture, and is interposed between said actuator member and said dome.

5. The switch assembly as recited in claim 3 wherein said aperture and said lower peripheral rim are circular and said aperture has a diameter between 40% to 60% of the diameter of said peripheral rim.

6. The switch assembly as recited in claim 5 wherein said actuator member has a sufficient clearance fit with respect to said aperture to allow deforming said dome without contacting said annular section.

7. The switch assembly as recited in claim 5 wherein said annular section is not attached to said lamp layer.

8. The switch assembly as recited in claim 1 wherein said contact members include an outer annular contact engaging said peripheral rim of said dome and an inner contact engaged upon deformation of said dome.

* * * * *